United States Patent [19]

Weber

[11] 4,186,656

[45] Feb. 5, 1980

[54] THERMAL BREAK VENTILATOR UNIT

[75] Inventor: Ronald J. Weber, Wausau, Wis.

[73] Assignee: Wausau Metals Corporation, Wausau, Wis.

[21] Appl. No.: 871,218

[22] Filed: Jan. 23, 1978

[51] Int. Cl.[2] ..... E06B 7/03

[52] U.S. Cl. ..... 98/99 R; 98/99.6

[58] Field of Search ..... 98/88, 97, 98, 99, 99.1, 98/99.2, 99.3, 99.4, 99.5, 99.6, 99.7, 99.8; 52/400, 730, 732; 49/40, 41

[56] References Cited

U.S. PATENT DOCUMENTS

| | | | |
|---|---|---|---|
| 495,288 | 4/1893 | Almy | 98/99.6 |
| 3,204,324 | 9/1965 | Nilsen | 52/730 X |
| 3,830,147 | 8/1974 | Weber et al. | 98/99.7 |

FOREIGN PATENT DOCUMENTS

| | | | |
|---|---|---|---|
| 1006828 | 10/1965 | United Kingdom | 98/98 |

*Primary Examiner*—William F. O'Dea

*Assistant Examiner*—Harold Joyce

*Attorney, Agent, or Firm*—Theodore J. Long; Harry C. Engstrom; Nicholas J. Seay

[57] ABSTRACT

A thermal break ventilator unit designed to extend between the opposed end jambs of a window frame. The thermal break ventilator unit has a box-shaped body with a ventilating passage therethrough. Essentially cylindrical, opposed raceways are attached to the opposed end jambs within the box-shaped body. A substantially drum-shaped closure unit rotates within the opposed raceways. The closure unit has a closed position wherein the ventilating passage is closed and an open position wherein the venilating passage is substantially unrestricted by the closure unit. Structural heat transfer barriers are incorporated into the metallic parts of the thermal break ventilating unit and are so located that, when the closure unit is in its closed position, there is no continuous, metallic path by which heat can flow between the interior and exterior parts of the ventilator unit.

13 Claims, 5 Drawing Figures

THERMAL BREAK VENTILATOR UNIT

BACKGROUND OF THE INVENTION

1. Field of the Invention

This invention relates generally to ventilator units and more particularly to metal ventilator units installed within a window frame.

2. Description of the Prior Art

The use of ventilator units constructed predominately of aluminum or other metals is common. The metal construction contributes to the unit's strength, durability, and resistance to weather. Furthermore, such shaping techiques as the extrusion of aluminum allow for the ready forming of complex channels, ridges, and other structures adapted to hold the glass of the window with which the ventilator is associated or to engage other surrounding structures.

Unfortunately, a heat transfer problem may be associated with the use of conventional metal ventilators. Heat from the warmer side of the ventilator flows through the metal to the other, cooler side, so that in winter, for example, a significant heat loss to the outside air may occur even though the ventilator itself is closed. The result is discomfort for occupants of the building, undesirable waste of energy, and higher fuel bills. In extreme cases, frost may form on the interior metal surfaces. The water formed when frost melts can damage paint, draperies, carpeting, or other materials with which it comes in contact. In the summer, exterior heat is transferred to interior, air conditioned areas in the same manner. Again, an undesirable waste of energy results.

SUMMARY OF THE INVENTION

I have invented a thermal break ventilator unit that can be conveniently constructed predominately of extruded metal and is adapted to extend between the opposed end jambs of a window, door, or other opening in a wall. My thermal break ventilator unit is designed so that, when the unit is closed, there is no continuous heat flow path through the metal of the unit between the exterior and interior surfaces. Instead, materials having substantially lower heat conductivity than the metal of the unit are interposed between the interior and exterior metal structures of the unit to effect a "thermal break" which reduces the flow of heat through the unit when the exterior and interior air temperatures differ. Consequently, my thermal break ventilator is less subject to frosting and water condensation problems than are conventional metal window ventilators. Heat loss from a building in winter is reduced, with resulting savings in fuel and heating costs and with improved comfort for occupants of the building, as well. Similarly, the reduced summer heat leak into air conditioned buildings equipped with my ventilator leads to additional energy and money savings.

My thermal break ventilator unit has an essentially rectangular, box-shaped body having parallel, top and base thermal break sections extending transversely between the opposed end jambs of the thermal break frame in which the unit is installed. These thermal break sections are spaced from each other to define, with the end jambs, a ventilating passage having exterior and interior ventilating openings. Each thermal break section has an interior and an exterior panel which are spaced from each other and rigidly connected by a structural heat transfer barrier having a low heat conductivity. The heat transfer barrier substantially thermally insulates the interior and exterior panels from each other.

My thermal break ventilator unit has two, opposed, substantially cylindrical raceways, one attached to each of the opposed end jambs between the base and top thermal break sections. Substantially cylindrical end races rotate within the opposed end jambs. The end races form part of the opposed end plates of a substantially drum-shaped, rotatable closure unit and are made of a material having a low heat conductivity. The closure unit has opposed, arcuate, inner and outer closure panels which are rigidly fastened to the end plates in spaced relation such that there is no metallic heat flow path between the closure panels. The closure panels are so positioned that when the closure unit is in its closed position, the inner and outer closure panels close the corresponding inner and outer openings of the ventilating passage. When the closure unit is rotated to its open position, the ventilating openings are substantially unrestricted by the closure panels. When the closure unit is in its closed position, there is no continuous, metallic path by which heat can flow between the interior and exterior parts of my thermal break ventilator unit.

A primary object of my invention is to provide a ventilator unit with a thermal break construction whereby the flow of heat between the interior and exterior parts of the unit will be minimized.

A second object of my invention is to provide a ventilator unit, the metal parts of which can be conveniently formed by the extrusion process.

Another object of my invention is to provide a ventilator unit so designed that its exterior appearance remains substantially the same whether opened or closed.

A further object of my invention is to provide a thermal break ventilator unit of simple construction in order to facilitate manufacture and reduce the possibilities of malfunction.

Other objects, features and advantages of my invention will be apparent from the following detailed description taken in conjunction with the accompanying drawings showing a preferred embodiment of my thermal break ventilating unit which exemplifies the principles of my invention.

DETAILED DESCRIPTION OF THE PREFERRED EMBODIMENT

Figure 1:
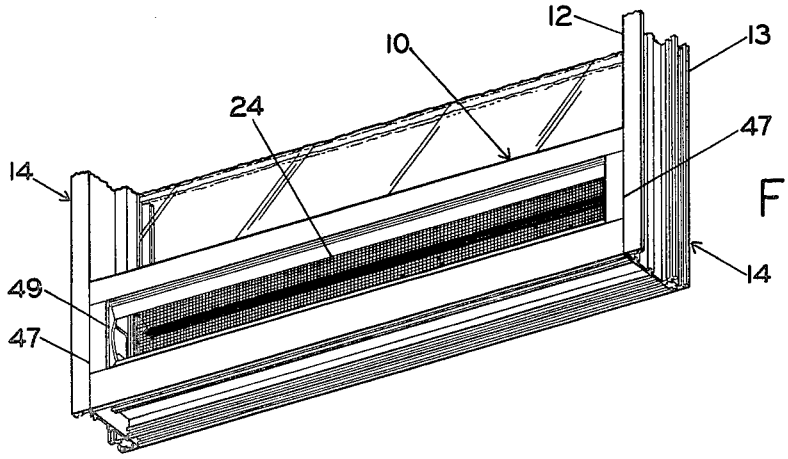
FIG. 1 is an isometric view of my thermal break ventilator unit in its open position showing the interior and bottom facing surfaces.
Figure 2:
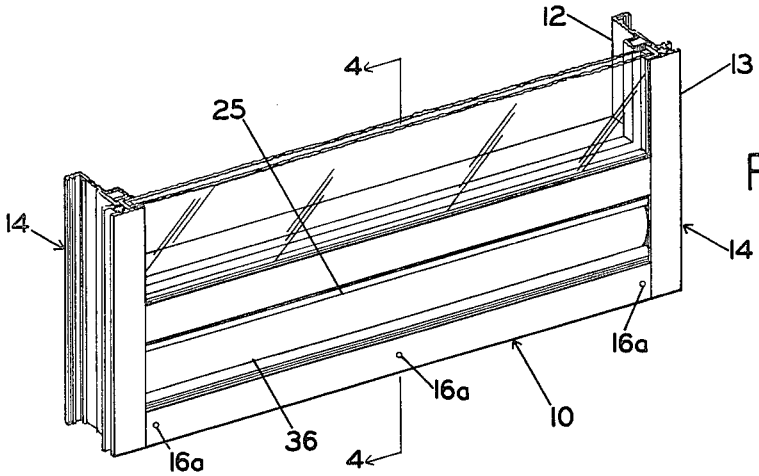
FIG. 2 is an isometric view of my thermal break ventilator unit in its closed position showing the exterior and top facing surfaces.

Referring more particularly to the drawings, wherein like numbers refer to like parts, FIGS. 1 and 2 illustrate my thermal break ventilator unit, shown generally at 10, installed at the bottom of an extruded aluminum window frame 11 having an interior side 12, an exterior side 13, an upper head member (not shown) and opposed end jambs 14 which are only partially shown in the drawings. The upper head member and each of the opposed end jambs 14 will be referred to herein as window frame members. Each of the window frame members has an interior panel and an exterior panel, both panels being extruded from aluminum. The interior and exterior panels of any given window frame member extend the length of the member and are rigidly connected and spaced from each other by a structural heat transfer barrier 11*a* made from a polyurethane resin having a substantially lower heat conductivity than the panels. The structural heat transfer barrier effects a "thermal break": an interruption in a heat flow path through a metal structure achieved by the incorporation in the structure of a heat flow barrier formed of a metarial of low heat conductivity. The barrier is so designed in a conventional manner that it substantially thermal isolates one part of the structure from another part. Taken together, the window frame members form a thermal break window frame adapted to restrict the flow of heat between the exterior and interior sections of the frame.

Figure 4:
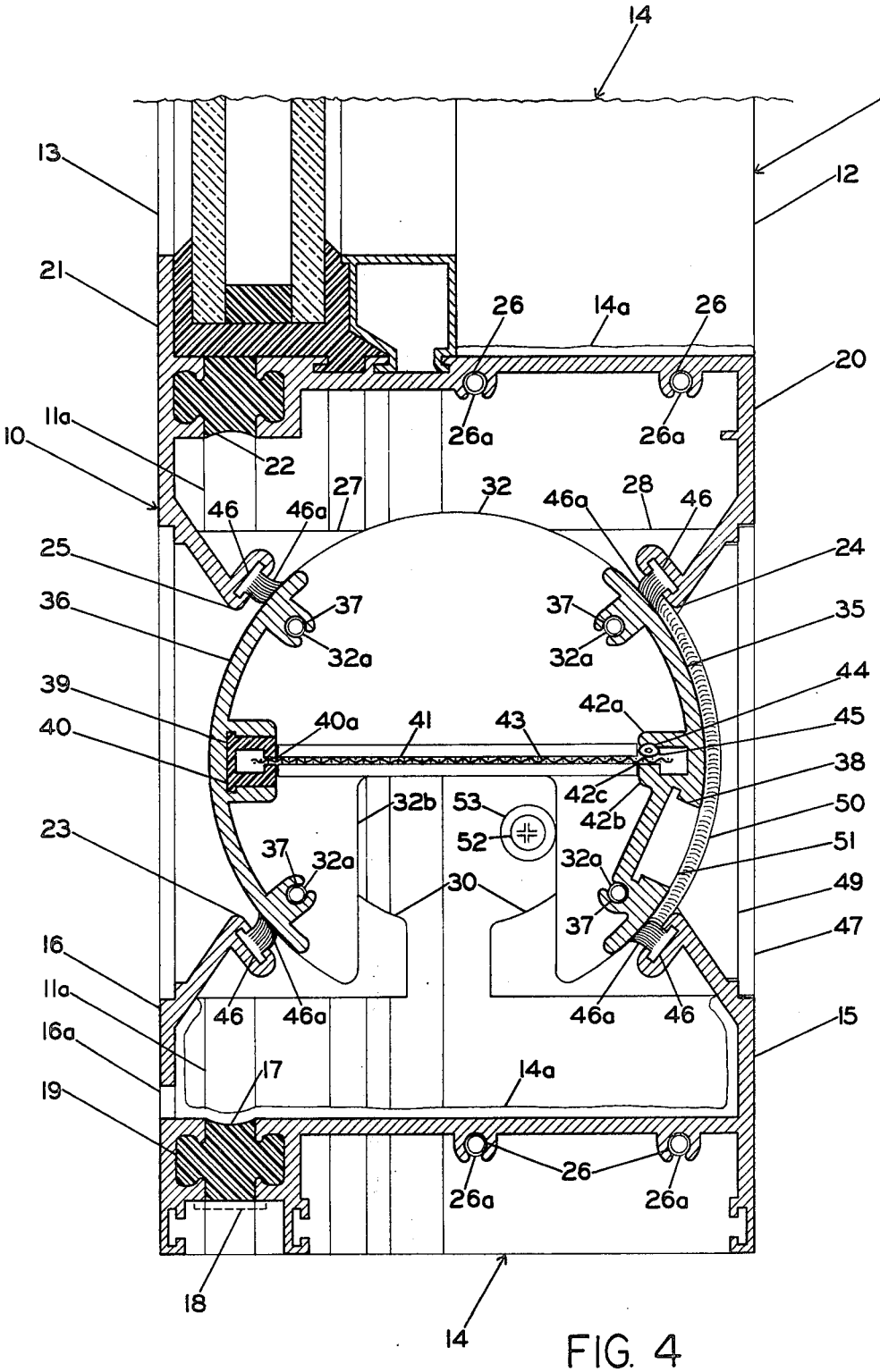
FIG. 4 is a section view of my thermal break ventilator unit in its closed position taken along section line 4—4 of FIG. 2.

My thermal break ventilator unit 10 includes an aluminum interior base panel 15 and an aluminum exterior base panel 16 extending transversely between the opposed end jambs 14 in combination therewith. The interior and exterior base panels are also rigidly connected and spaced from each other by a poured molded structural heat transfer barrier 17 integrally joined to the spaced panels. The structural heat transfer barrier is made from a polyurethane resin having a substantially lower heat conductivity than the panels so that the structural heat transfer barrier interrupts the path through the metal base panels by which heat could otherwise readily flow between the interior and exterior sides of the ventilator unit. In practice, the interior and exterior base panels are originally formed as a single aluminum extrusion having a channel 19 partially defined by a metal bridge 18 (shown in phantom in FIG. 4) connecting the interior and exterior base panels. The polyurethane resin is then flowed into the channel 19 and is allowed to polymerize, whereupon the metal bridge 18 is removed by milling. Taken together, the interior and exterior base panels and the associated structural heat transfer barrier form a thermal break base section.

My thermal break ventilator unit also has an aluminum interior top panel 20 and an aluminum exterior top panel 21 extending transversely between the opposed end jambs 14. The interior and exterior top panels are rigidly connected and spaced from each other by a structural heat transfer barrier 22 made from a polyurethane resin having a substantially lower heat conductivity than the panels. Taken together, the interior and exterior top panels and the associated structural heat transfer barrier form a thermal break top section. The thermal break top section is made by a method analogous to the conventional method already described for making the thermal break base section. The top section is located above and spaced from the base section to define, with the connected end jambs 14, a ventilating passage 23 therebetween. The interior margin of the ventilating passage forms an interior ventilating opening 24. Similarly, the exterior margin of the ventilating passage forms an exterior ventilating opening 25.

The top and base thermal break sections have screw-receiving channels 26 extending the length of the extruded sections and adapted to threadedly receive sheet metal screws. The opposed end jambs 14 have holes (not shown) located to correspond to the position of the screw-receiving channels when the top and base sections are in place. Sheet metal screws 26*a* extend from outside the opposed end jambs through the holes to threadedly engage the channels 26 and rigidly attach the base and top thermal break sections to the end jambs. Conventional caulking 14*a* seals any space between the end jambs and the top and base sections and thereby prevents the entrance of water into the ventilating unit. The exterior base panel 16 has at least one weep hole 16*a* by which any water which does enter or form within the ventilating unit may drain out on the exterior side of the unit.

My thermal break ventilator unit also has two sets of associated exterior 27 and interior 28 jamb raceway guides. The jamb raceway guides are made of molded acetal or a similar, strong material having a low heat conductivity. Each exterior jamb raceway guide 27 has two mounting holes 29 and each interior jamb raceway guide 28 has two mounting slots 31. One set of jamb raceway guides is attached to each of the opposed end jambs 14 between the base and top sections by means of mounting screws (not shown) which extend through the mounting holes 29 and slots 31 to threadedly engage tapped holes (not shown) appropriately located in the opposed end jambs. The mounting screws are countersunk so that the heads of the screws do not project beyond the surface of the jamb raceway guides. Each interior and exterior jamb raceway guide has a concave, arcuate guide surface 30 facing its associated jamb raceway guide in spaced relation, the two sets thereby defining two, opposed, substantially cylindrical raceways. The mounting slots 31 of each interior jamb raceway guide 28 are laterally elongated parallel to a line bisecting the arc defined by the concave guide surface 30 of the interior jamb raceway guide and radial with respect thereto. The width of each raceway may be adjusted by moving the interior jamb raceway guide 28 toward or away from the exterior jamb raceway guide 27 to a desired position and then tightening the mounting screws extending through the slots 31, thereby securing the interior jamb raceway guide rigidly to the end jamb. The margins of the mounting slots are countersunk so that the heads of the mounting screws do not project beyond the exposed surfaces of the jamb raceway guides. Clearly, other equivalent means for adusting the widths of the two opposed raceways could be employed.

Figure 3:
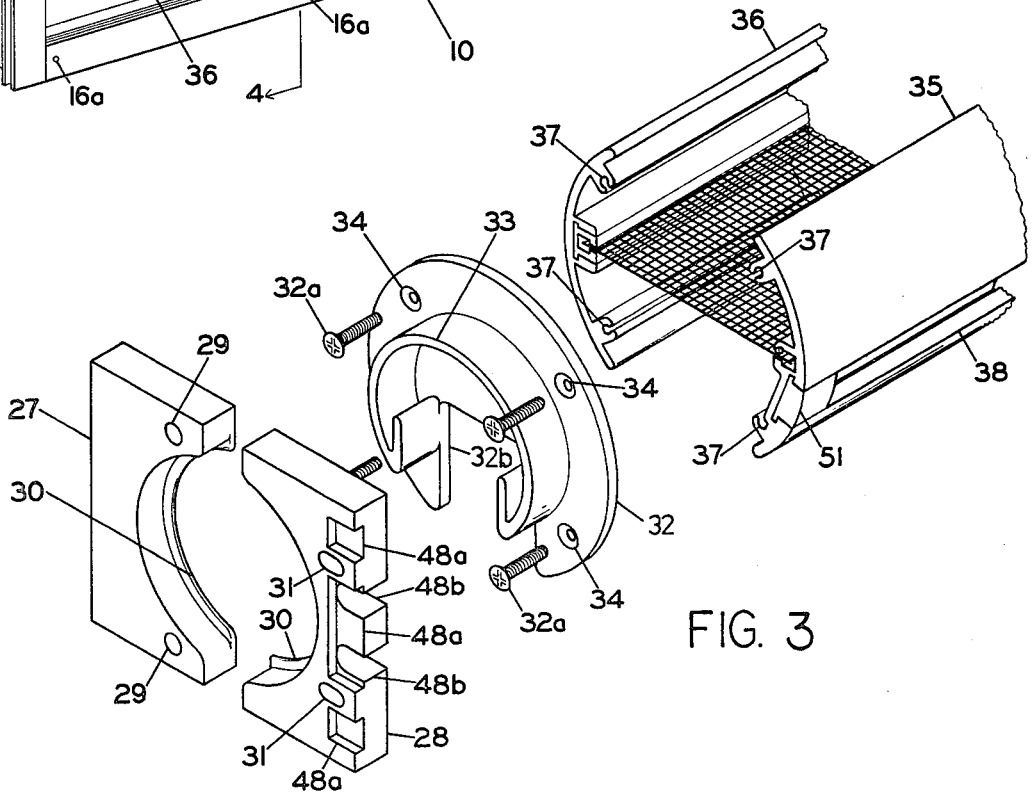
FIG. 3 is an exploded isometric interior view of one end of the closure unit of my thermal break ventilator unit with its associated exterior and interior jamb raceway guides.

My thermal break ventilator unit also has two, opposed, substantially circular door end plates 32 having convex, substantially cylindrical end races 33. The convex end races 33 provide extended arcuate support surfaces which are rotatably engaged within the opposed raceways. The opposed door end plates 32 are made of molded acetal or some other strong material having a low heat conductivity. The door end plates have screw holes 34, shown in FIG. 3, to allow the attachment of closure panels. Opposed, arcuate, inner 35 and outer 36 closure panels extend transversely between the opposed door end plates 32 in spaced relation. The interior surface of each closure panel has two screw receiving channels 37 extending the length of the panel. The closure panels are rigidly fastened to the door end plates by sheet metal screws 32*a* that extend through the screw holes 34 and threadedly engage the screw receiving channels 37. Clearly, other equivalent means for attaching closure panels could be devised.

Figure 5:
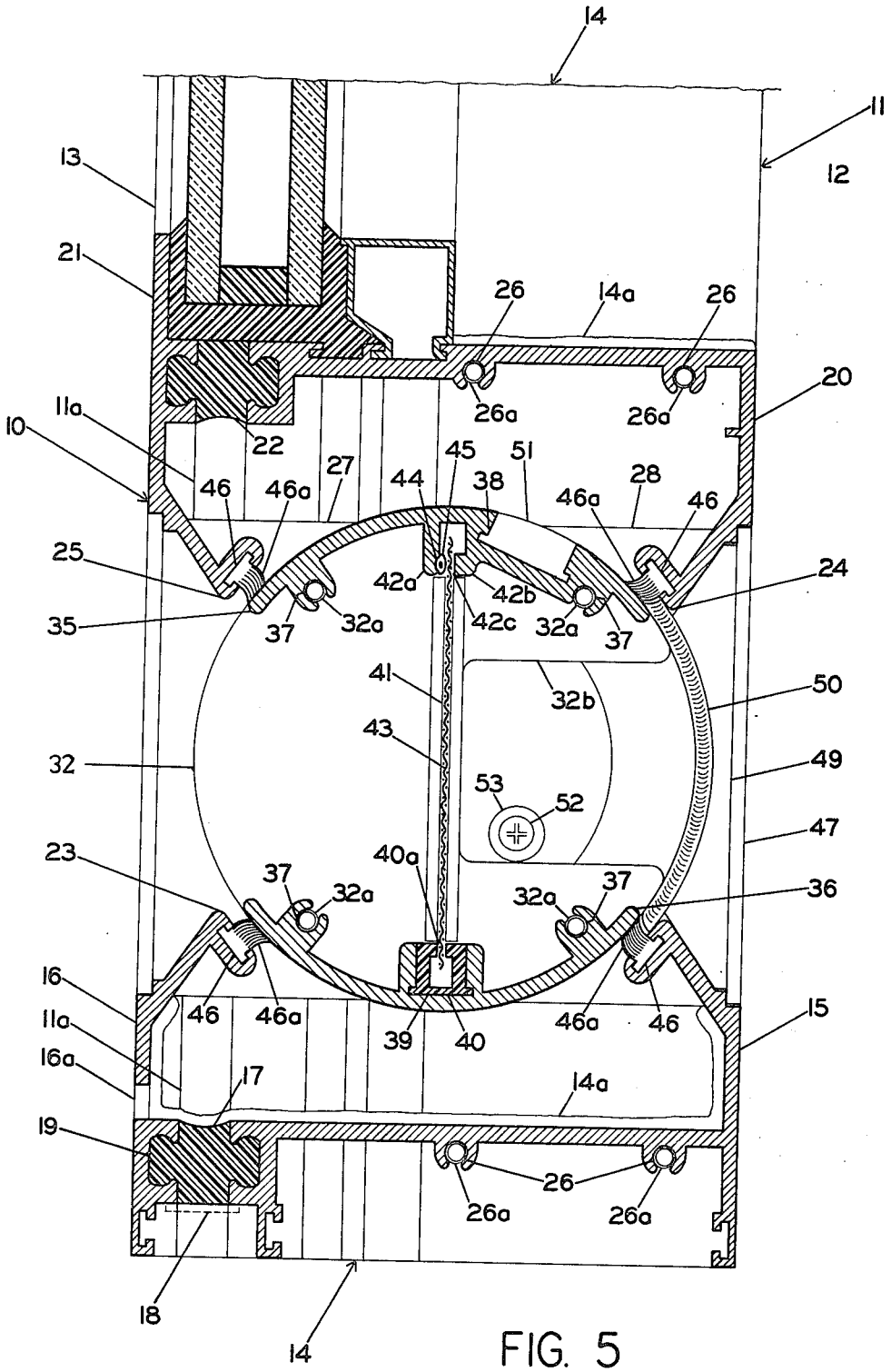
FIG. 5 is a section view of my thermal break ventilator unit in its open position and taken along the same section line as FIG. 4.

The door end plates, which have a substantially lower heat conductivity than the closure panels, constitute a thermal break, which in conjunction with the air space between the closure panels interrupts the flow of heat that might otherwise occur between the closure panels were they connected by elements having high heat conductivity characteristics. Taken together, the opposed door end plates 32 and the inner and outer closure panels 35 and 36 form a substantially drum-shaped thermal break closure unit. The closure unit has a closed position, shown in FIGS. 2 and 4, wherein the inner closure panel 35 closes the interior ventilating opening 24 and the outer closure panel 36 closes the exterior ventilating opening 25. By rotating the closure unit approximately 90 degrees, the closure unit may be moved to an open position wherein the ventilating passage 23 is substantially unrestricted by the closure panels, as shown in FIGS. 1 and 5. The inner closure panel preferably has a handle slot 38 extending the length of the inner closure panel. The handle slot is wide and deep enough to receive the fingertips of a user of my ventilating unit and facilitates the rotation of the closure unit.

The inwardly facing surface of the outer closure panel 36 has a channel 39 extending the length thereof, and substantially centered relative to the width of the closure panel. The channel is adapted to engage a screen-holding strip 40 which extends substantially the length of the channel. The screen-holding strip has a holding slot 40*a* extending for its entire length. Each of the opposed door end plates 32 preferably has a holding slot 41 extending diametrically across its inwardly facing surface and so located as to constitute a continuation of the holding slot 40*a*. The inwardly facing surface of the inner closure panel 35 preferably has two inwardly projecting ridges 42*a* and 42*b* which extend the length of the inner closure panel and define a holding slot 42*c* which constitutes a continuation of the holding slots 41. Taken together, the holding slots 40*a*, 41 and 42*c* serve as locating means for positioning and holding at least one air-transmitting protective screen 43 which extends across the ventilating passage 23 when the closure unit is in the open position. The protective screen can be an insect screen, as shown, a strong security screen adapted to prevent the passage of solid objects of a selected size through the ventilating passage, or any combination of such screens.

The closure panel ridge 42*a* preferably has a channel 44 extending for the length of the ridge and facing the closure panel ridge 42*b*. A roll-in screen retainer 45 in the form of a flexible, vinyl tube extends substantially the length of holding slot 42*c*. The screen retainer 45 is engaged within the holding slot 42*c* between the screen 43 and the channel 44 on the closure panel ridge 42*a* to retain the screen 43 within the channel 44. The screen retainer 45 is of such a size that it is slightly compressed when so engaged to hold the screen 43 firmly in place. The screen-holding strip 40 is made from a material having a low heat conductivity, such as vinyl, and thereby serves to interrupt the flow of heat between the screen and the outer closure panel. As a result, the thermal break characteristics of the closure unit are maintained.

At least one rigid intermediate bracing plate (not shown) adapted to substantially maintain the spatial relationship between the inner and outer closure panels 35 and 36 may be provided within the closure unit between the closure panels and at selected points between the door end plates. The bracing plate should extend between the closure panels and be rigidly engaged therewith. The bracing plate may most conveniently be adapted to removably snap into the opposed screw receiving channels 37 of the closure panels and may be of any desired shape receivable between the panels. When a protective screen 43 is used, two such bracing plates may be employed one extending between the closure panels on one side of the screen and the other located in a corresponding position on the other side of the screen. The intermediate bracing plates should be made of molded acetal or some other strong material having a low heat conductivity, thereby maintaining the thermal break characteristics of the closure unit.

Two aluminum interior jamb closure pieces 47 may preferably extend between the to and base sections, one interior jamb closure piece contiguous with each of the opposed end jambs 14 as best shown in FIG. 1. Each interior jamb closure piece preferably has a bracing member (not shown) which extends inwardly into the ventilating unit in a plane parallel to the surface of the associated end jamb and contiguous therewith. The interior jamb raceway guides 28 have notches 48*a* adapted to provide room for the bracing members. The bracing members have holes (not shown) through which attachment screws (not shown) extend. The opposed end jambs have tapped holes (not shown) which threadedly engage the attachment screws, thereby rigidly holding the interior jamb closure pieces in place. The interior jamb raceway guides 28 also have access notches 48*b* which allow convenient access to the attachment screws.

Each interior jamb closure piece 47 has a channel (not shown) extending for substantially the length of the interior jamb closure piece. A molded acetal jamb filler 49 is adapted to slip underneath the interior jamb closure piece and substantially fill the space between the jamb closure piece 47, the interior base and top panels 15 and 20, and the inner closure panel 35 as viewed in FIG. 4. Each molded jamb filler has a ridge (not shown) adapted to engage the channel on the inwardly facing surface of the associated interior jamb closure piece, whereby the molded acetal jamb filler is held in place. The molded acetal jamb filler is flexible enough to allow it to be snapped into place in engagement with the interior jamb closure piece 47 and the base and top panels 15 and 20, or removed, by hand.

Pile-type weather stripping 50 is affixed to that surface of each molded acetal jamb filler 49 which faces and is contiguous to the inner closure panel 35. In practice, a tape (not shown) having adhesive on both sides is a convenient means of affixing the insulating strip. Acetal door fillers 51 adapted to fill the handle slot 38 extend inwardly from the ends of the handle slot sufficiently far to provide a surface against which the weather stripping 50 can press to provide continuous sealing contact between the weather stripping and the closure unit in the closed position illustrated in FIG. 4.

Those margins of the base and top sections that define the interior and exterior ventilating openings 24 and 25 have weather stripping channels 46 adapted to engage pile-type weather stripping 46*a*. The weather stripping extends for substantially the length of the top and base sections to slidably engage the adjacent closure panels 35 and 36. The weather stripping 50 and the weather stripping *46a* associated with the interior ventilating opening 24 slidably and continuously engage the inner closure panel when the closure unit is in the closed position to provide a substantially air-tight closure of the ventilating passage 23.

Each of the door end plates 32 has a substantially square-bottomed access notch *32b* downwardly opening when the closure unit is closed. The access notch *32b* is deep enough so that the shortest distance from the bottom thereof to that point on the periphery of the door end plate which is directly opposite to the notch is less than the width of the inner ventilating opening 24. The access notches allow the fully assembled closure unit to be removed in one piece from the body of the ventilator unit through the interior ventilating opening 24, after the jamb filler 49, interior jamb closure pieces 47 and the interior jamb raceway guides 28 have first been removed. The interior base panel 15 will project into the access notches when the closure unit is pulled toward the interior side of the ventilator unit to permit the closure unit to be rolled out over the interior base panel. At least one resilient plastic tube 53 is fastened to an end jamb 14 by a screw 52 extending through the tube 53 and threadedly engaging a tapped hole in the end jamb (not shown). The tube is located so that the side of an access notch *32b* comes to rest against the tube as the closure unit is rotated to its closed position illustrated in FIG. 4, the tube thereby serving as a limit stop restricting the further rotation of the closure unit. The width of the access notch is such that the opposite side of the access notch does not contact the limit stop as the closure unit is being rotated toward its open position until the closure unit has reached its open position as shown in FIG. 5.

Although in this preferred embodiment I have described my thermal break ventilator unit as extending transversely between the opposed end jambs of a window frame, it is clear that the ventilating unit could be enclosed in a frame of its own without any associated window, or associated with a door rather than a window, or located at the top, the bottom, or some intermediate point in window frame, or installed on end with the unit extending vertically between horizontally disposed end jambs of a frame. None of these arrangements would depart from the scope and spirit of my invention. Similarly, a metal other than aluminum could be used in the construction of my thermal break ventilator unit, and means of fashioning the metal parts of my ventilator unit other than extrusion could be used.

It is understood that my invention is not confined to the particular embodiments herein illustrated and described, but embraces all such modified forms thereof as come within the scope of the following claims.

I claim:

1. In a thermal break frame having opposed end jambs each having spaced internal and external panels connected by a structural heat transfer barrier of substantially lower heat conductivity than the connected panels, a thermal break ventilator unit comprising, in combination:

(a) spaced thermal break sections extending between and connected to the opposed end jambs to define a ventilating passage therebetween, the thermal break sections each having spaced internal and external panels connected by a structural heat transfer barrier of substantially lower heat conductivity than the connected panels, the internal and external panels of the thermal break sections respectively defining therebetween interior and exterior ventilating openings of the ventilating passage, (b) opposed inner and outer closure panels connected in spaced relation by plates of low heat conductivity to form a closure unit positioned for movement within the ventilating passage, the inner closure panel closing the interior ventilating opening and the outer closure panel closing the exterior ventilating opening, the plates and a closed air space extending between the closure panels cooperating to provide a thermal break for interrupting the flow of heat between the panels when the closure unit is positioned in its closed position and both closure panels permitting substantially unrestricted air flow through the ventilating passage when the closure unit is positioned in its open position, and (c) at least one guide member having an extended arcuate guide surface being attached to each of the opposed end jambs between the thermal break sections, and wherein at least two of the plates connecting the closure panels each have a mating extended arcuate surface for engagement with one of the guide member surfaces in slidable relation whereby the closure unit will be rotatably mounted within the ventilating passage.

2. The thermal break ventilator unit specified in claim 1 wherein the opposed closure panels each have locating means for engaging at least one air-transmitting protective screen extending therebetween, at least one of the locating means including insulating means of substantially lower heat conductivity than the associated closure panel to provide a thermal break between the screen and the associated closure panel.

3. The thermal break ventilator unit specified in claim 1 wherein a weather strip extends around the periphery of at least one of the ventilating openings to frictionally engage the corresponding closure panel in slidable relation when the closure unit is in the closed position to provide a substantially air-tight closure of the ventilating passage.

4. The thermal break ventilator unit specified in claim 1 wherein the panels are constructed of metal material.

5. A thermal break ventilator unit within a thermal break frame having opposed end jambs, an interior side, and an exterior side, the ventilator unit comprising:

(a) interior and exterior base panels extending transversely between the opposed end jambs and being rigidly connected in spaced, thermally insulated relation by a structural heat transfer barrier having a substantially lower heat conductivity than the base panels to form a thermal break base section, (b) interior and exterior top panels extending transversely between the opposed end jambs and being rigidly connected in spaced thermally insulated relation by a structural heat transfer barrier having a lower heat conductivity than the top panels to form a thermal break top section, the top section being in spaced relation to the base section to define a ventilating passage therebetween, the interior margin of the ventilating passage forming an interior ventilating opening and the exterior margin of the ventilating passage forming an exterior ventilating opening, (c) two sets of associated exterior and interior jamb raceway guides, one set attached to each of the opposed end jambs between the base and top sections, the jamb raceway guides each having a concave, arcuate guide surface facing its associated jamb raceway guide in spaced relation, the two sets defining two, opposed, substantially cylindrical raceways, (d) opposed door end plates composed of a material having a lower heat conductivity than the top and base panels and each having a convex, substantially cylindrical end race rotatably engaged within one of the opposed raceways, and having means for attaching closure panels, and (e) opposed, arcuate, inner and outer closure panels extending transversely between the opposed door end plates and fixedly engaged thereto in spaced relation by the attaching means to form a closure unit having a closed position wherein the inner closure panel closes the interior ventilating opening and the outer closure panel closes the exterior ventilating opening, and an open position wherein the ventilating openings are substantially unrestricted by the closure panels.

6. The thermal break ventilator unit specified in claim 5 wherein the opposed closure panels have locating means for positioning and holding at least one air-transmitting protective screen and being adapted to substantially thermally insulate the screen from at least one of the closure panels, and including at least one protective screen engaged by the locating means and extending across the ventilating passage when the closure unit is in its open position.

7. The thermal break ventilator unit specified in claim 6 wherein at least one protective screen is an insect screen.

8. The thermal break ventilator unit specified in claim 5 including means for adjusting the widths of the two, opposed raceways, said adjusting means having at least one mounting slot in one of each set of jamb raceway guides, which slot extends parallel to a line bisecting the arc defined by the concave guide surface of the slotted jamb raceway guide and radial with respect thereto, and a mounting screw extending through each mounting slot and threadedly engaging the associated end jamb at a desired distance from the associated jamb raceway guide.

9. The thermal break ventilator unit specified in claim 5 wherein a weather strip extends around the periphery of at least one of the ventilating openings to frictionally engage the corresponding closure panel in slidable relation when the closure unit is in the closed position to provide a substantially air-tight closure of the ventilating passage.

10. In a thermal break frame having opposed end jambs each having spaced internal and external panels connected by a structural heat transfer barrier of substantially lower heat conductivity than the connected panels, a thermal break ventilator unit comprising, in combination:

(a) spaced thermal break sections extending between and connected to the opposed end jambs to define a ventilating passage therebetween, the thermal break sections each having spaced internal and external panels connected by a structural heat transfer barrier of substantially lower heat conductivity than the connected panels, the internal and external panels of the thermal break sections respectively defining therebetween interior and exterior ventilating openings of the ventilating passage, (b) a set of associated exterior and interior jamb raceway guides attached to each of the opposed end jambs between the spaced thermal break sections, the jamb raceway guides each having a concave arcuate guide surface facing its associated jamb raceway guide in spaced relation to define a pair of substantially cylindrical opposed raceways, and (c) opposed inner and outer closure panels connected in spaced relation by plates of low heat conductivity to form a closure unit positioned for movement within the ventilating passage, the inner closure panel closing the interior ventilating opening and the outer closure panel closing the exterior ventilating opening, the plates and a closed air space extending between the closure panels cooperating to provide a thermal break for interrupting the flow of heat between the panels when the closure unit is positioned in its closed position and both closure panels permitting substantially unrestricted air flow through the ventilating passage when the closure unit is positioned in its open position, one said closure unit plate being located at each end of the closure unit and having a convex, substantially cylindrical end race rotatably engaged within one of the opposed raceways.

11. The thermal break ventilator unit specified in claim 10 including means for adjusting the widths of the opposed raceway guide.

12. The thermal break ventilator unit specified in claim 11 wherein the means for adjusting the widths of the two opposed raceways includes at least one mounting slot in one of each set of jamb raceway guides, which slot extends parallel to a line bisecting the arc defined by the concave guide surface of the slotted jamb raceway guide and radial with respect thereto, and a mounting screw extending through each mounting slot and threadedly engaging the associated end jamb at a desired distance from the associated jamb raceway guide.

13. In a thermal break frame having opposed end jambs each having spaced internal and external panels connected by a structural heat transfer barrier of substantially lower heat conductivity than the connected panels, a thermal break ventilator unit comprising, in combination:

(a) spaced thermal break sections extending between and connected to the opposed end jambs to define a ventilating passage therebetween, the thermal break sections each having spaced internal and external panels connected by a structural heat transfer barrier of substantially lower heat conductivity than the connected panels, the internal and external panels of the thermal break sections respectively defining therebetween interior and exterior ventilating openings of the ventilating passage, (b) opposed inner and outer closure panels connected in spaced relation by plates of low heat conductivity to form a closure unit positioned for movement within the ventilating passage, the inner closure panel closing the interior ventilating opening and the outer closure panel closing the exterior ventilating opening, the plates and a closed air space extending between the closure panels cooperating to provide a thermal break for interrupting the flow of heat between the panels when the closure unit is positioned in its closed position and both closure panels permitting substantially unrestricted air flow through the ventilating passage when the closure unit is positioned in its open position, the plates each having an extended arcuate support surface, and (c) at least one guide member fixedly positioned between the thermal break sections in engagement with the arcuate support surface of each plate to support the plate arcuate surface in rotatable relation with respect to the thermal break sections and permit rotational movement of the closure unit between its open and closed positions.

* * * * *